US005992932A

United States Patent [19]

Kain et al.

[11] Patent Number: 5,992,932

[45] Date of Patent: Nov. 30, 1999

[54] RELEASE MECHANISM FOR TRAY

[75] Inventors: James M. Kain, Tipp City, Ohio; Michael S. Rosko, Greenwood, Ind.

[73] Assignee: Cosco, Inc., Columbus, Ind.

[21] Appl. No.: 09/092,217

[22] Filed: Jun. 5, 1998

Related U.S. Application Data

[60] Provisional application No. 60/048,832, Jun. 6, 1997.

[51] Int. Cl.[6] ..... A47B 39/00

[52] U.S. Cl. ..... 297/153; 297/151

[58] Field of Search ..... 297/135, 148, 297/149, 151, 153; 108/157.11

[56] References Cited

U.S. PATENT DOCUMENTS

| | | |
|---|---|---|
| D. 283,956 | 5/1986 | Lemmeyer . |
| 1,983,138 | 12/1934 | Lehman . |
| 2,505,490 | 4/1950 | Greenbaum . |
| 2,799,324 | 7/1957 | Anderson . |
| 3,330,597 | 7/1967 | Lay et al. . |
| 3,475,052 | 10/1969 | Kaposi . |
| 3,490,808 | 1/1970 | Siegel . |
| 3,649,074 | 3/1972 | McDonald et al. . |
| 4,105,247 | 8/1978 | Saint . |
| 4,580,833 | 4/1986 | Waples . |
| 4,582,359 | 4/1986 | Wise et al. . |
| 4,653,805 | 3/1987 | Maloney . |
| 4,723,813 | 2/1988 | Kassai . |
| 4,807,928 | 2/1989 | Cone . |
| 4,842,331 | 6/1989 | Waples . |
| 4,968,092 | 11/1990 | Glambrone . |
| 5,118,161 | 6/1992 | Slows et al. . |
| 5,183,311 | 2/1993 | Meeker et al. . |
| 5,238,292 | 8/1993 | Golenz et al. . |
| 5,348,374 | 9/1994 | Kuo . |
| 5,438,938 | 8/1995 | Meeker et al. . |
| 5,489,138 | 2/1996 | Mariol et al. . |
| 5,527,090 | 6/1996 | Cone . |
| 5,558,400 | 9/1996 | Poulson et al. . |
| 5,609,389 | 3/1997 | Longoria et al. . |

OTHER PUBLICATIONS

Instructions for Contemporary Flair Chair#, 4358–1959, Cosco, Inc., undated.

Fisher Price Model No. 9261/9372/9373 photographs A–D, purchased 1997.

Graco Model No. B–3170AM photographs A & B, purchased 1997.

*Primary Examiner*—Milton Nelson, Jr.

*Attorney, Agent, or Firm*—Barnes & Thornburg

[57] ABSTRACT

A tray assembly is provided for use with a seat having a seat back, a seat bottom, and arms. The tray assembly includes a tray and a latch coupled to the tray. The tray has an upper surface, first and second edges, and walls coupled to the edges and lower surface to define a cavity therebetween. A rib extends from at least one of the walls of the tray and the latch includes a slot for receiving the rib therein. In addition, the latch is configured to move between a latched position in which the latch is adapted to engage the arms of the seat and a release position in which the latch is adapted to disengage the arms of the seat.

27 Claims, 8 Drawing Sheets

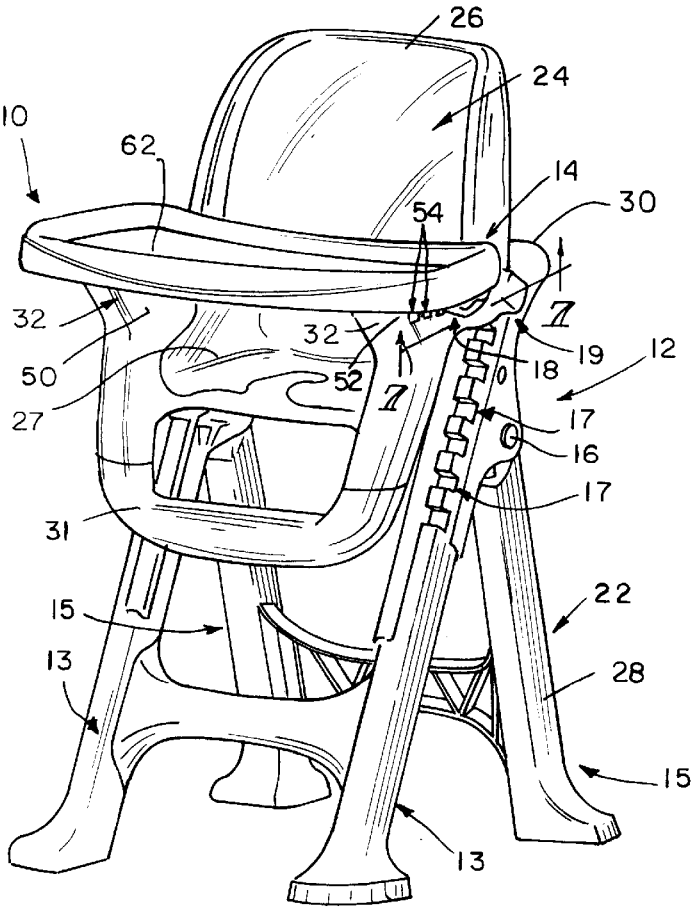
FIG. 1
FIG. 3
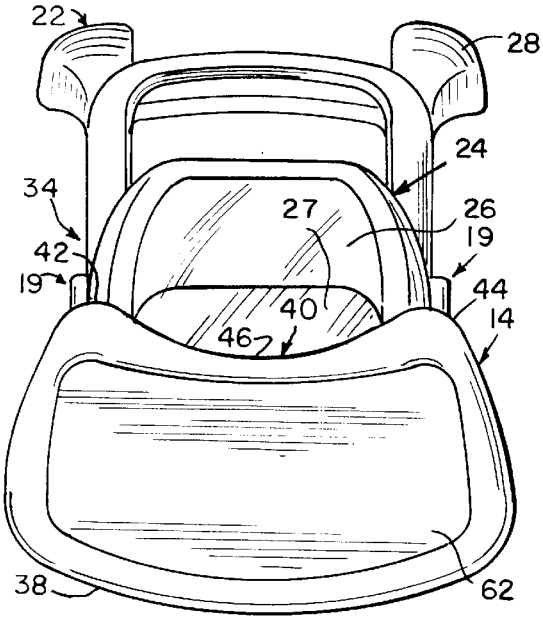
FIG. 2
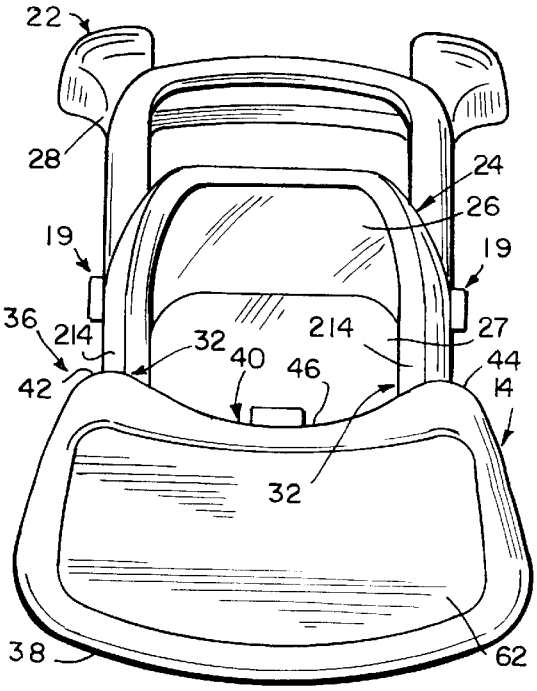

RELEASE MECHANISM FOR TRAY

This claims priority under 35 U.S.C. §119(e) of Ser. No. 60/048,832, filed Jun. 6, 1997.

BACKGROUND AND SUMMARY OF THE INVENTION

The present invention relates to tray assemblies for juvenile chairs, and particularly to adjustable tray assemblies that include a quick-release mechanism. More particularly, the present invention relates to an adjustable tray assembly that is manually releasable from a juvenile chair using either one or two hands.

Trays are traditionally used with juvenile chairs to provide a platform on which a caregiver can place items for a child such as food, toys, and so forth. See, for example, U.S. Pat. Nos. 4,807,928 to Cone and 5,527,090 to Cone. Caregivers, many times, must remove a tray from a juvenile chair while holding or watching a fussy infant or toddler. This is often difficult if two hands must be used to operate a chair-release mechanism provided under the tray.

According to the present invention, a tray assembly is provided for use with a seat having a seat back, a seat bottom, and arms. The tray assembly includes a tray and first and second latches adapted for engagement with the arms of the seat. Each latch is movable relative to the tray between a latched position in which the latch is adapted to engage the arms of the seat and an unlatched position in which the first latch is adapted to disengage the arms of the seat. The tray is formed to an upper surface, a lower surface, and walls extending from the lower surface and forming a cavity for receiving each latch therein. A rib is formed to extend from on or more of the walls and each latch is formed to include a slot for receiving the rib therein.

In preferred embodiments, each latch includes a mounting portion, a release handle coupled to the mounting portion, and teeth extending from the mounting portion adapted to be received within slots formed in an exterior surface of each arm of the seat. Each mounting portion includes a pin to mount the respective latch to the walls of the tray for pivoting movement relative to the tray. The tray assembly additionally includes springs extending from a floor portion of each latch and the lower surface of the tray to normally bias each latch toward the latched position so that the teeth extend into slots formed in the arms of the seat. Each tooth includes a tapered bottom surface for guiding the teeth into the slots of the arms of the seat as the tray is being inserted upon the seat.

Features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying Figures in which:

FIG. 1 is a perspective view of a tray assembly in accordance with the present invention mounted upon a juvenile chair including a frame and a seat mounted upon the frame, the seat having a seat back, a seat bottom, and arms positioned to lie on opposite ends of the seat bottom, and showing the tray assembly including a tray and first and second latches coupling the tray to the arms of the seat;

FIG. 2 is a top view of the tray assembly of FIG. 1, showing the tray in a retracted position wherein the tray is positioned to lie adjacent to the seat back of the seat;

FIG. 3 is a view of the tray assembly of FIG. 1, showing the tray in an expanded position wherein the tray is spaced-apart from the seat back of the seat.

DETAILED DESCRIPTION OF THE DRAWINGS

Figure 4:
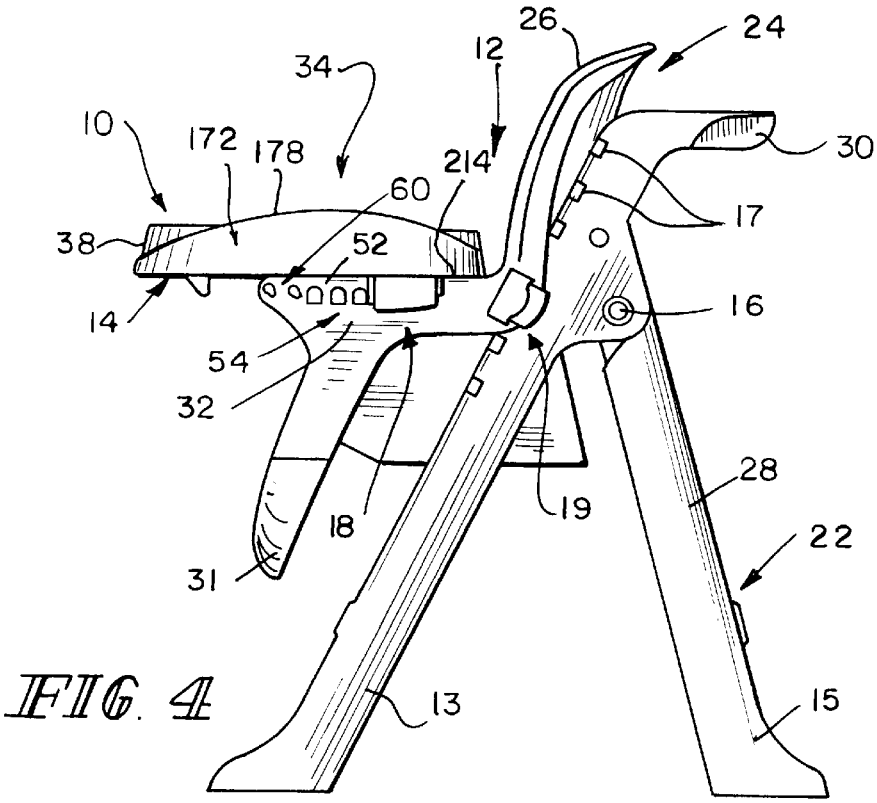
FIG. 4 is a side view of the tray assembly of FIG. 2, showing the tray in the retracted position wherein each latch engages first and second slots of six tray-position slots formed in the arms of the seat.

A tray assembly 10 in accordance with the present invention is shown in FIG. 1 as it would appear to a caregiver after it had been mounted onto a juvenile chair 12. Juvenile chair 12 is formed to include a frame 22 and a seat 24 mounted to frame 22 and formed to include a seat back 26, a seat bottom 27, and two arms 32 positioned to lie at opposite ends of seat bottom 27. Tray assembly 10 provides a tray 14 and two latches 18 for coupling tray 14 to seat 24. Latches 18 enable the caregiver to use either one or both of their hands to mount and remove tray 14 from seat 24.

Figure 5:
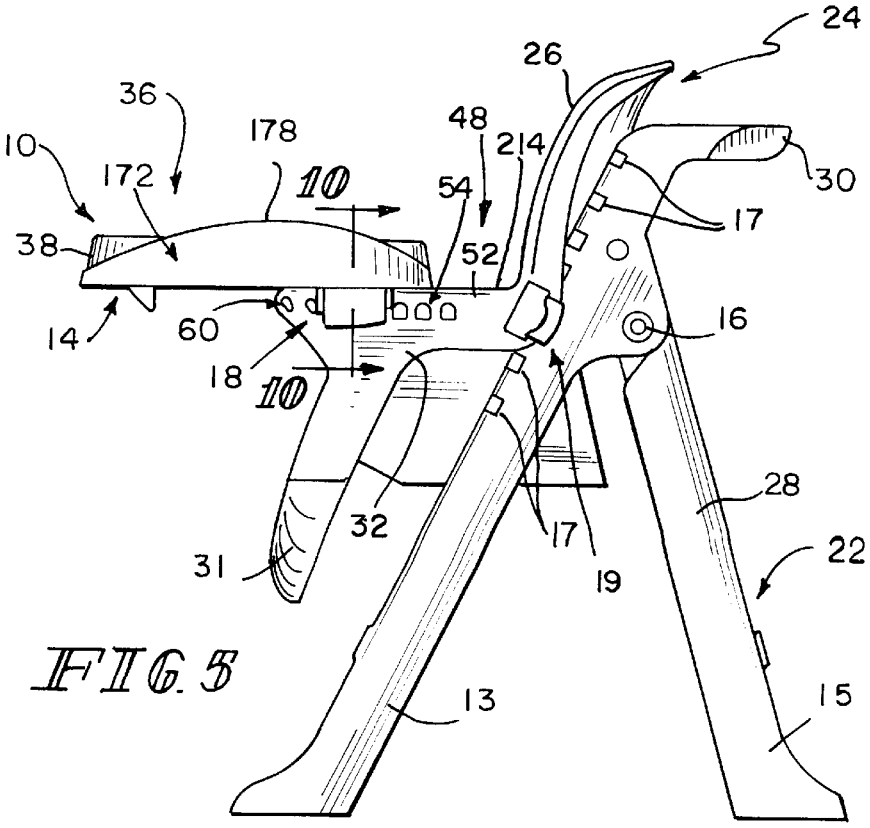
FIG. 5 is a side view of the tray assembly of FIG. 3 showing the tray in the expanded position wherein each latch engages fifth and sixth slots of six tray-position slots formed in the elevated arms of the seat.

Tray assembly 10 is coupled to seat 24 of juvenile chair 12 so that tray 14 extends across arms 32 of seat 24 as shown in FIGS. 1, 4, and 5. As stated above, juvenile chair 12 includes frame 22 and seat 24 mounted upon frame 22. Juvenile chair 12 additionally includes a height-adjustment mechanism 19 formed to fix seat 24 in a vertical position on frame 22. Frame 22 includes front legs 13 and rear legs 15 so that front legs 13 are pivotally coupled to rear legs 15 by pivot posts 16. Front legs 13 include height-position slots 17 to permit extension of height-adjustment mechanism 19 therein so that seat 24 is held in a variety of elevated positions on frame 22. Incorporated herein by reference are U.S. patent applications entitled "Juvenile Chair" to James M. Kain and Michael S. Rosko, filed herewith and "Tray Assembly with Crotch Post" to James M. Kain and Michael S. Rosko filed herewith. In addition, it is understood that a wide variety of frames and seats with and without height-adjustment mechanisms may be used in accordance with the present invention.

Figure 6:
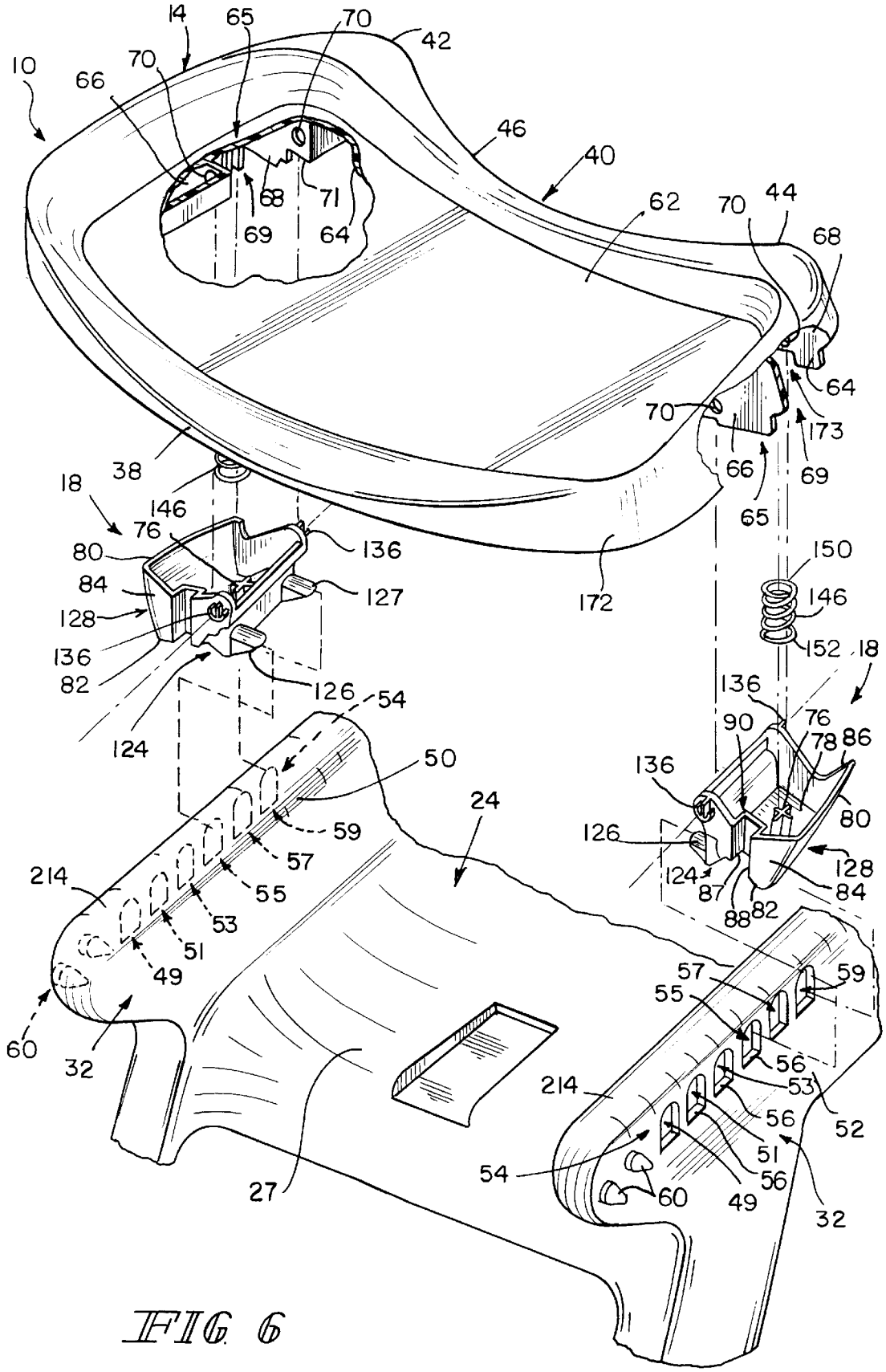
FIG. 6 is an exploded assembly view of the seat and tray assembly of FIG. 1, the portions broken away, showing the tray including latch-receiving portions having apertures formed therein, and the two latches each including pivot posts for extension through the apertures, a spring-biased mounting portion supporting the pivot posts, a release lever coupled to the mounting portion and mounting teeth extending from the mounting portion of each latch for extension into the tray-position slots.

As shown in FIG. 1, seat 24 supporting tray assembly 10 includes a seat back 26, a seat bottom 27, a foot rest 31, and arms 32. Arms 32 are configured to receive tray assembly 10 thereon for locking tray assembly 10 onto seat 24. Arms 32 each include an interior surface 50 extending from seat bottom 27, an opposite exterior surface 52 and a tray mount surface 214 extending between exterior and interior surfaces 52, 50. Exterior surface 52 is formed to include a plurality of tray-position slots 54 opening away from seating portion 27. Slots 54 are sized to permit extension of each corresponding latch 18 therein so that tray assembly 10 is held in a variety of positions on arms 32 between a fully-retracted position 34 as shown in FIGS. 2 and 4, and a fully-expanded position 36 as shown in FIGS. 3 and 5. As shown in FIG. 6, exterior surface 52 includes a last slot 49, a first slot 59, and four intermediate tray-position slots 51, 53, 55, 57 positioned to lie between first and last slots 59, 49. Each slot 49, 51, 53, 55, 57, 59 is defined by a surface 56 so that surface 56 is positioned to lie generally parallel to seat bottom 27. Arms 32 additionally include stops 60 that block each latch 18 from sliding past fully-expanded position 36 and off arms 32 of seat 24.

Referring now to FIG. 2, tray 14 includes a convex outward edge 38 extending outwardly over frame 22 and an opposite inward edge 40. Inward edge 40 includes opposite ends 42, 44 and a concave child-receiving edge 46 extending therebetween. Child-receiving edge 46 allows opposite ends 42, 44 of inward edge 40 to lie adjacent to seat back 26 of seat 24 while still allowing a smaller child to sit comfortably on seat bottom 27 between tray 14 and seat back 26 of seat 24.

Tray assembly 10 as it would appear in fully-expanded position 36 is illustrated in FIGS. 3 and 5. Referring to FIG. 5, tray 14 in expanded position 36 lies spaced-apart from seat back 26 and extends over foot rest 31 of chair 24. Thus, as shown in FIG. 3, opposite ends 42, 44 of inward edge 40 of tray 14 are spaced-apart from seat back 26. This fully-expanded position 36 gives a larger child more space 48 between child-receiving edge 46 and seat back 26 of seat 24. Tray 14 may be situated in five positions including fully-retracted and fully-expanded positions 34, 36. It is within the scope of the present invention, however, to provide arms 32 and latches 18 which cooperate to situate tray 14 in greater or fewer than five positions. Each latch 18 of tray assembly 10 allows the caregiver to adjust positioning of tray assembly 10 relative to seat back 26 between fully-retracted and fully-expanded positions 34, 36.

Figure 7:
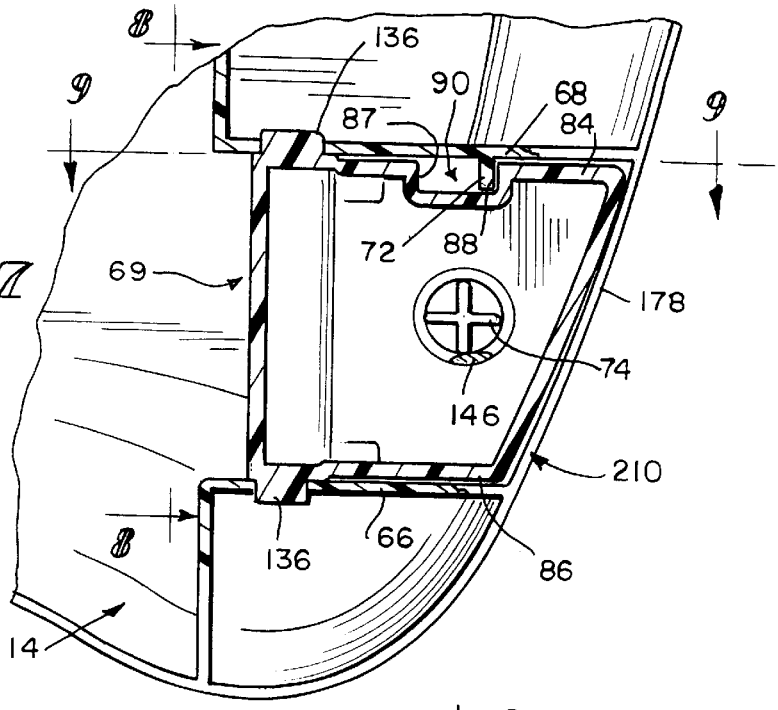
FIG. 7 is a view taken along lines 7—7 of FIG. 1, showing one latch-receiving portion of the tray including upstanding walls that define a latch-receiving cavity, a rib extending into the latch-receiving cavity, and the pivot posts of the latch extending through the upstanding walls and showing one of the latches including an interior wall learned to include a limit slot to receive the rib for limiting the pivoting movement of the latch relative to the tray.
Figure 8:
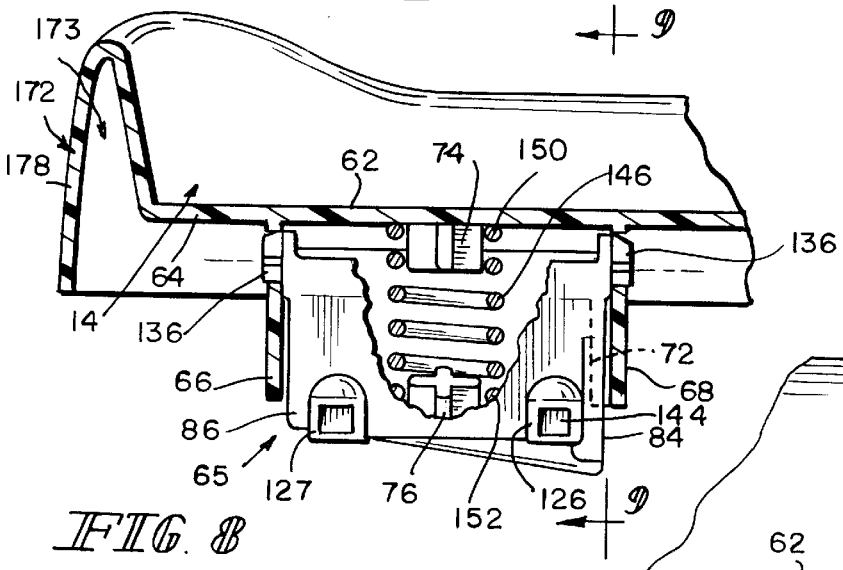
FIG. 8 is a view taken along lines 8—8 of FIG. 7, showing the mounting portion of the latch including two spaced-apart mounting teeth and the limit slot being formed in the interior wall adjacent to one of the mounting teeth.

Referring now to FIG. 6, tray 14 includes an upper surface 62 for receiving items such as child toys, food, or other such items (not shown), and a lower surface 64 facing seat bottom 27 of seat 24. Tray 14 also includes an outer lip 172 positioned about a perimeter. Lip 172 includes a concave surface 178 that defines a U-shaped cavity 173. Lip 172 may be formed in a wide variety of shapes and sizes in accordance with the present invention. Lower surface 64 is formed to include two latch-receiving portions 65 for mounting respective latches 18 to tray 14. Each latch-receiving portion 65 includes spaced-apart upright walls 66, 68 that extend in a downward direction from lower surface 64 toward seat bottom 27 to define a latch-receiving cavity 69 therebetween. Each upright wall 66, 68 also includes a chamfer 71 to aid in assembly of each latch 18 with tray 14 to provide tray assembly 10 as will be discussed below. Each upright wall 66, 68 is additionally formed to include aperture 70 therethrough. As shown in FIG. 7, wall 68 includes a rib 72 that extends toward wall 66 and into latch-receiving cavity 69. Tray 14 also includes a spring boss 74 formed to extend into cavity 69.

Referring still to FIG. 6, tray assembly 10 includes two latches 18. Latches 18 are configured to release tray 14 from seat 24 to enable caregiver to slide tray 14 on arms 32 between fully-retracted position 34 and fully-expanded position 36. Latches 18 also enable the caregiver to remove tray 14 from seat 24. Since latches 18 are positioned adjacent to outer ends 42, 44 of tray 14, a caregiver may have easy access to each latch 18 for removing tray assembly 10 from seat 24. Only one latch 18 and arm 32 will be described herein, although it is understood that the description applies to each latch 18 and arm 32.

Latch 18 includes a mounting portion 124, a release handle 128 coupled to mounting portion 124, and teeth 126, 127 extending from mounting portion 124. Mounting portion 124 is positioned to lie adjacent to exterior surface 52 of arm 32 and is coupled with arm 32. Mounting portion 124 of latch 18 includes pivot posts 136 that extend through apertures 70 formed in walls 66, 68 of tray 14. Latch 18 is thus coupled to walls 66, 68 of tray 14 for pivoting movement therewith.

Release handle 128 is provided so that caregiver may lift release handle 128 to disengage corresponding mounting latch 124 from arm 32. When at least one latch 18 is moved to an arm-release position and thus disengaged from corresponding arm 32, tray 14 and disengaged latch 18 may then be pivoted about opposite engaged latch 18 which remains in an arm-lock position and thus engaged with opposite side arm 32. Once pivoted, engaged latch 18 may be disengaged from arm 32 by laterally moving tray assembly 10 away from arm 32 as shown by arrow 100 in FIG. 16. Thus, latch 18 facilitates one-handed release of tray assembly 10 from chair 24 by the caregiver.

Figure 9:
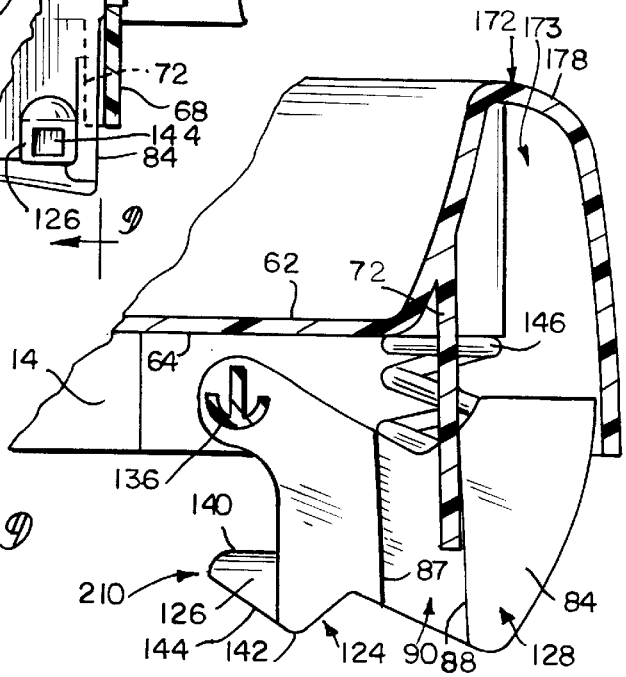
FIG. 9 is a view taken along lines 9—9 of FIG. 7 showing the tray including an outer rim defining a U-shaped cavity and the release lever of one of the latches having an upper guide portion positioned to lie in the U-shaped cavity and showing the latch positioned to lie in a fully-extended position wherein the rib engages a first internal wall portion of the limit slot.

Mounting teeth 126, 127 are configured for extension into tray-position slots 54 formed in arm 32 of seat 24. As shown in FIG. 9, mounting teeth 126, 127 include an outward portion 140 formed to face lower surface 64 of tray 14 and an inward portion 142. Teeth 126, 127 also include a tapered portion 144 positioned on inward portion 142. Tapered portion 144 is configured to engage tray mount surface 214 as each latch 18 is seated upon arms 32. Specifically, tapered portion 144 is configured to guide pivoting movement of respective mechanism 18 on arms 32 during installation of tray 14 on seat 12.

Figure 10:
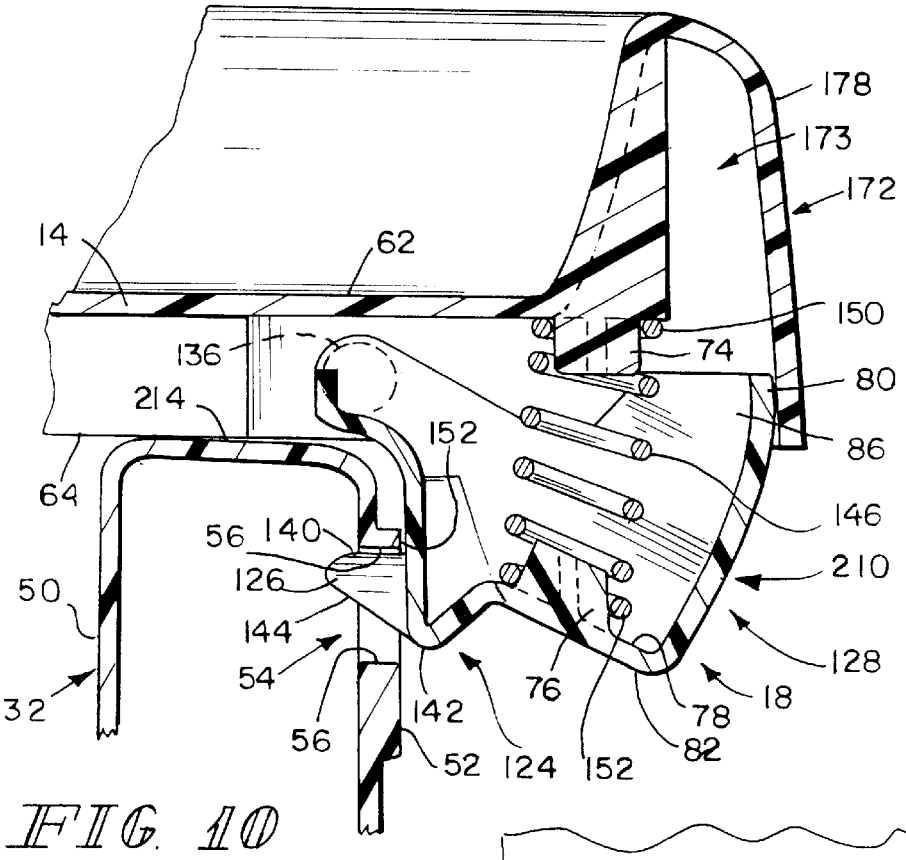
FIG. 10 is a view taken along line 10—10 of FIG. 5 showing the latch in the fully-extended position so that the latch is in an engaged position in which the mounting tooth of the mounting portion is spring biased into one of the tray-position slots of the arms of the seat.
Figure 11:
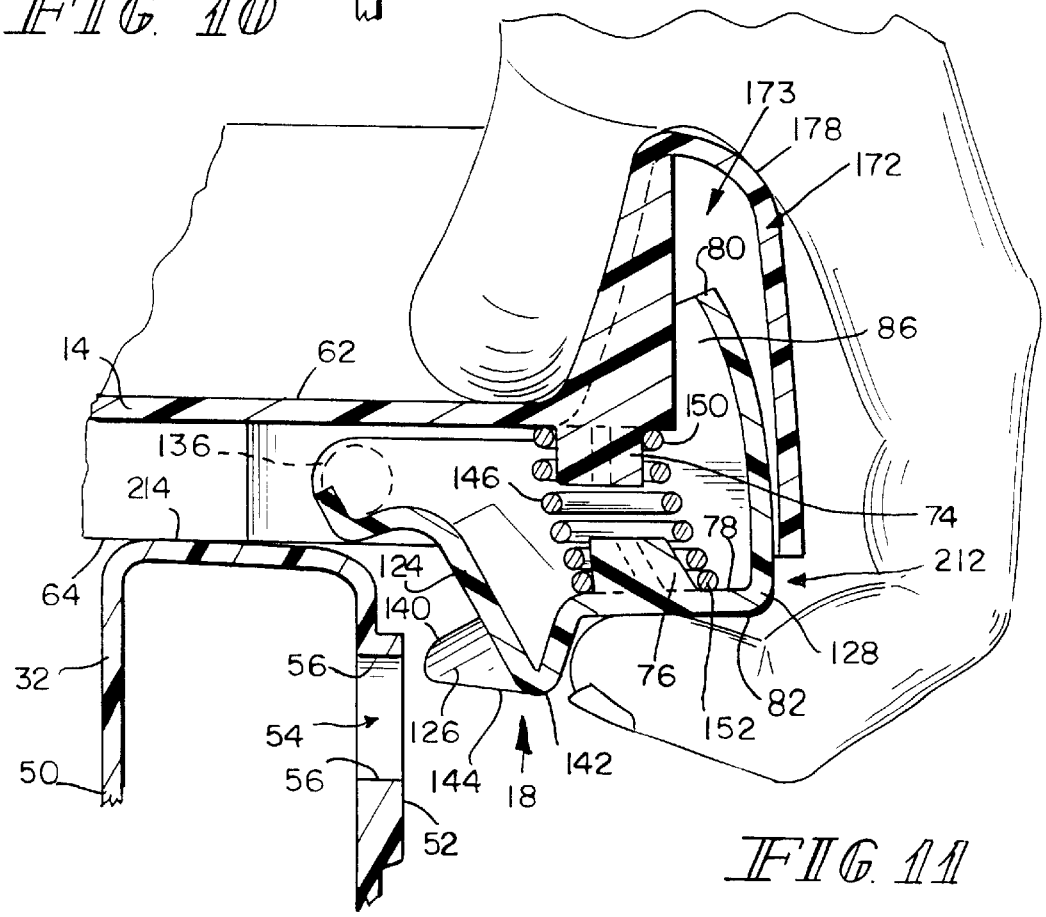
FIG. 11 is a view similar to FIG. 10, showing manual compression of the latch to a fully-compressed position so that the latch is in a disengaged position in which the mounting tooth is removed from the tray-position slot thus enabling the tray to be removed from the arms of the seat.
Figure 12:
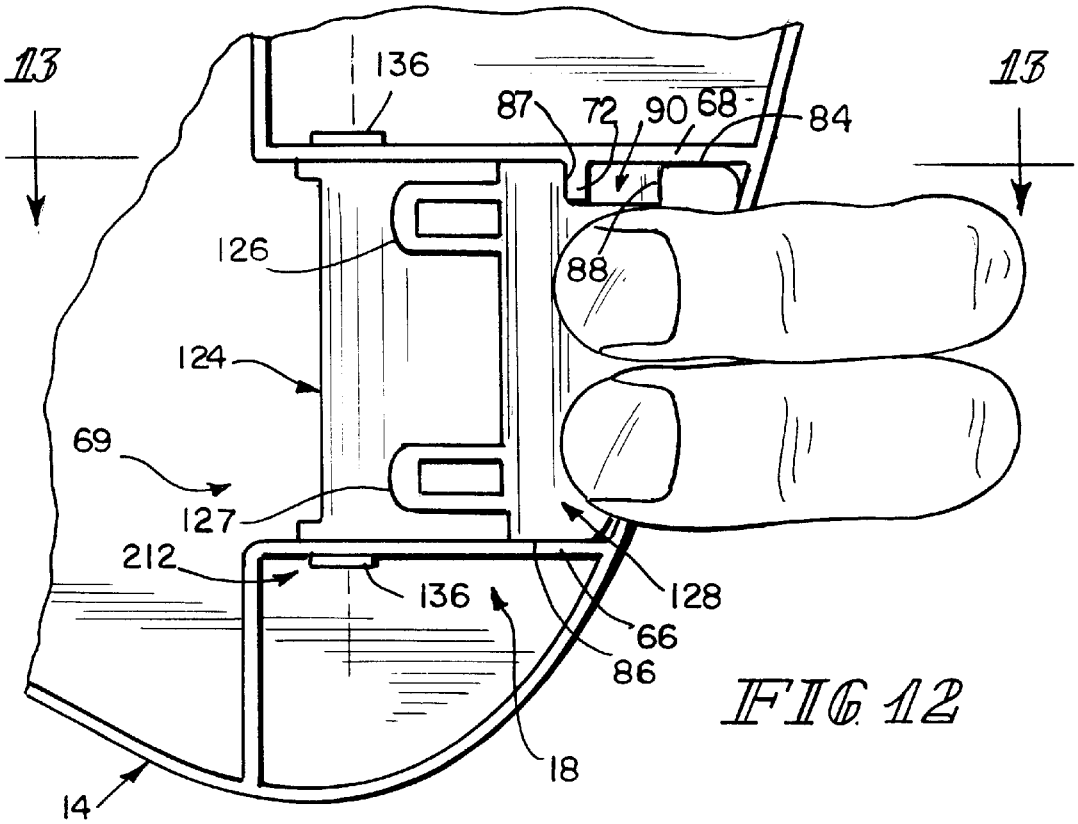
FIG. 12 is a bottom view of the latch of FIG. 11 showing the latch in the fully-compressed position so that the rib engages a second internal wall of the limit slot to block additional pivoting movement of the latch away from the arms of the seat.

As shown in FIG. 6, release handle 128 is configured to enable a caregiver to manually move latch 18 from a fully-extended position 210 shown in FIG. 9 to a fully-compressed position 212 shown in FIG. 11 so that each latch 18 is either engaged or disengaged from respective arm 32. Release handle 128 includes an upper portion 80 positioned to lie in cavity 173 of lip 172 and an opposite hand-gripping portion 82 as shown in FIGS. 10 and 11. Side walls 84, 86 extend between upper portion 80 and hand-gripping portion 82 and are configured to lie within latch-receiving cavity 69 adjacent to upright walls 68, 66, respectively. Side wall 84 is additionally formed to include a first internal wall portion 88 and a second internal wall portion 87 so that internal wall portions 87, 88 define a limit slot 90 sized to receive rib 72 of wall 68 therein as shown in FIG. 7.

Figure 13:
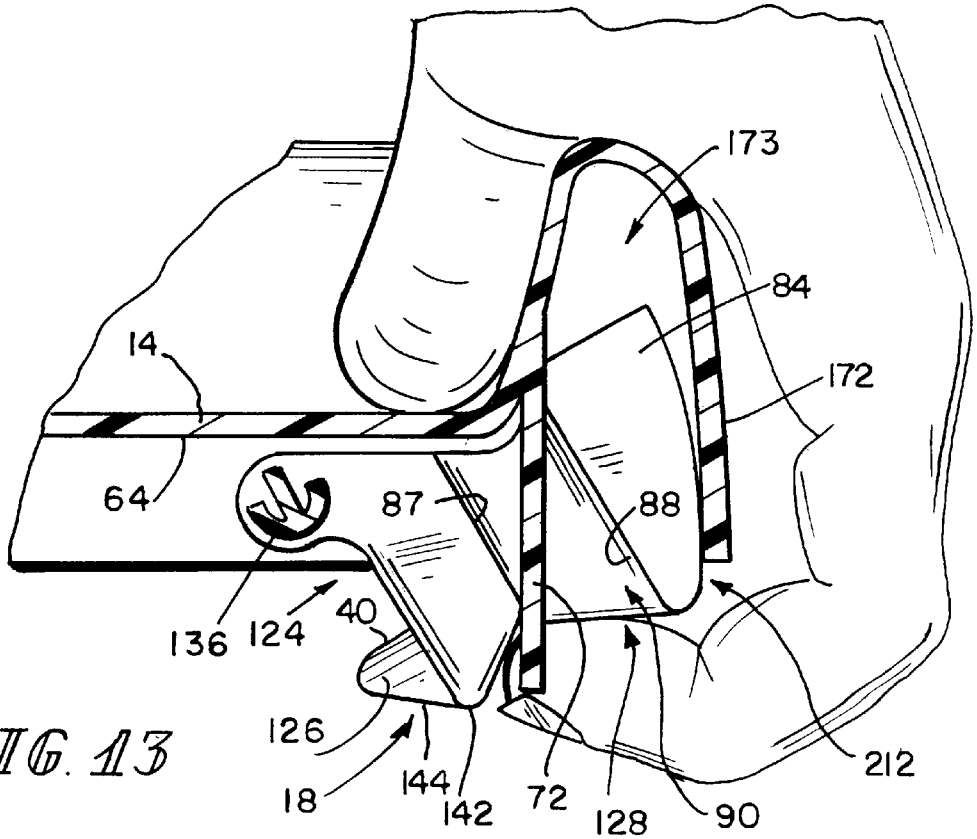
FIG. 13 is a view taken along lines 13—13 of FIG. 12 showing the latch in the fully-compressed position so that the rib engages the second internal wall of the limit slot and the upper guide portion lies within the U-shaped cavity of the tray.

Internal wall portions 87, 88 forming slot 90 of release handle 128 pivot with latch 18 relative to tray 14 in response to the pivoting movement of pivot posts 136 extending through aperture 70 of walls 66, 68. As shown in FIGS. 9 and 13, pivoting movement of posts 136 causes first and second internal wall portions 88, 87 of slot 90 to engage rib 72 when latch 18 is in fully-extended and fully-compressed positions 210, 212, respectively. Thus, as hand-gripping portion 82 pivots toward cavity 173 formed by lip 172, second interior wall portion 87 is moved toward rib 72. By engaging second interior wall portion 87 when latch mechanism 18 is moved toward fully-compressed position 212, rib 72 acts to block additional pivoting movement of release handle 128 toward lip 172. Alternately, when latch 18 is in fully-extended position 210 as shown in FIGS. 9 and 10, rib 72 engages first internal wall portion 88 of slot 90. Thus, rib 72 blocks additional pivoting movement of teeth 126, 127 through tray-position slots 54.

As shown in FIG. 6, release handle 128 includes a floor portion 78 that extends between opposite side walls 84, 86 and a spring boss 76 coupled to floor portion 78. A locking spring 146 extends between tray 14 and latch 18 and includes an outward end 150 formed for extension about spring boss 74 of tray 14 and an inward end 152 formed for extension about spring boss 76. Locking spring 146 normally biases latch 18 toward fully-extended position 210.

To mount tray assembly 10 on seat 24, a caregiver first grasps tray 14. Latches 18 are then aligned with arms 32 of seat 12 so that taper portion 144 of each tooth 126, 127 engages tray mount surface 214. The caregiver then presses tray 14 downward toward arms 32 until lower surface 64 of tray 14 engages tray mount surface 214 of arms 32. During this pressing movement, tapered portions 144 of teeth 126, 127 engage arms 32 and thus urge each latch 18 toward fully-compressed position 212 away from interior surface 50 of arms 32. Once lower surface 64 of tray 14 engages tray mount surface 214 of arms 32, though, each spring 146 normally urges respective latch 18 toward fully-extended position 210 so that latch 18 is engaged with exterior surface 52 of arms 32.

If teeth 126, 127 are in an off-set alignment with slots 54, spring 146 urges teeth 126, 127 into engagement with exterior surface 52 of arm 32. The caregiver must then simply slide tray 14 on arms 32 toward either retracted and expanded positions 34, 36 to align teeth 126, 127 with slots 54. Once teeth 126, 127 are in alignment with slots 54, spring 146 urges mounting teeth 126 127 to be received within slots 54. Once teeth 126, 127 are received within slots 54, assembly 10 has been successfully mounted on seat 24. Each latch mechanisms 18 rests in fully-extended position 210 engaged with corresponding arm 32. Following attachment of tray assembly 10 to seat 24, lower surface 64 of tray 14 rests securely upon tray mount surface 214 of arms 32 in a fixed position.

To adjust tray assembly 10 on seat 24, a caregiver must first grasp each latch 18. Both release levers 128 are moved in an upward direction away from lower surface 64 of tray 14 to move latches 18 toward fully-compressed positions 212. When in fully-compressed position 212, each latch 18 is disengaged from arms 32 so that teeth 126, 127 of mounting latch 124 are pivoted away from slots 54 of arms 32. In this position, latches 18 no longer couple tray 14 to arms 32 and tray assembly 10 is movable on arms 32. Caregiver may then simply slide tray 14 upon surface 214 to the desired retracted position 34, expanded position 36 or any number of intermediate positions (not shown) between retracted and expanded positions 34, 36. To fix tray 14 to arms 32 of seat 24 after adjusting the positioning of tray 14 relative to arms 32 to accommodate the child, the caregiver must simply release both latches 18. As described previously, locking spring 146 biases each latch 18 toward fully-extended position 210 into engagement with arms 32 of seat 24. Mounting teeth 126, 127 of mechanism 18 thus pivot to be received within slots 54 of arms 32.

Figure 14:
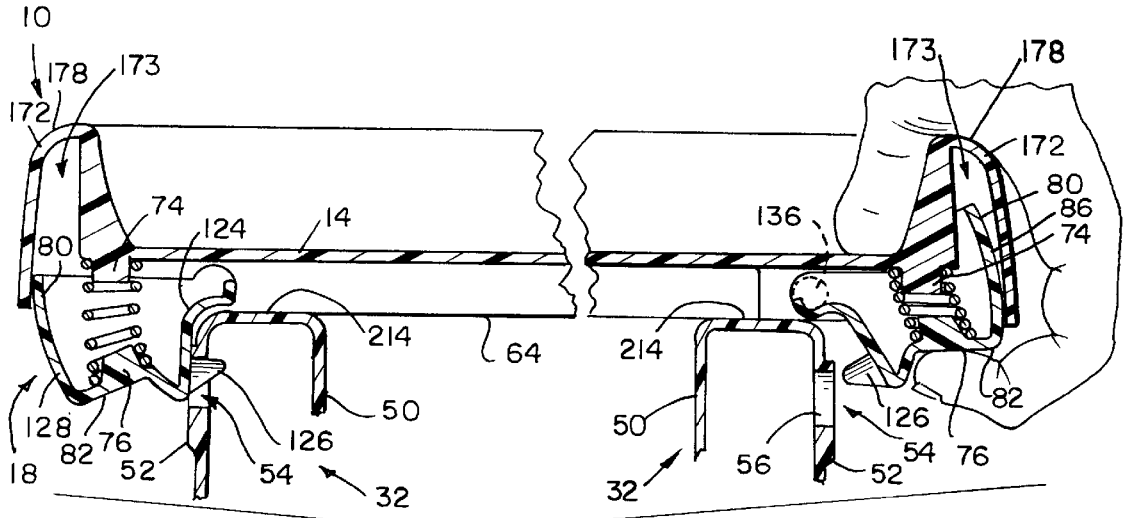
FIG. 14 is a view similar to FIG. 13, showing the entire tray assembly and arms of the seat wherein the first latch is in the engaged position coupling the tray to one arm of the seat and the second latch is in the disengaged position so that the mounting tooth of the second latch is not received within any of the tray-position slots of the corresponding arm of the seat.
Figure 15:
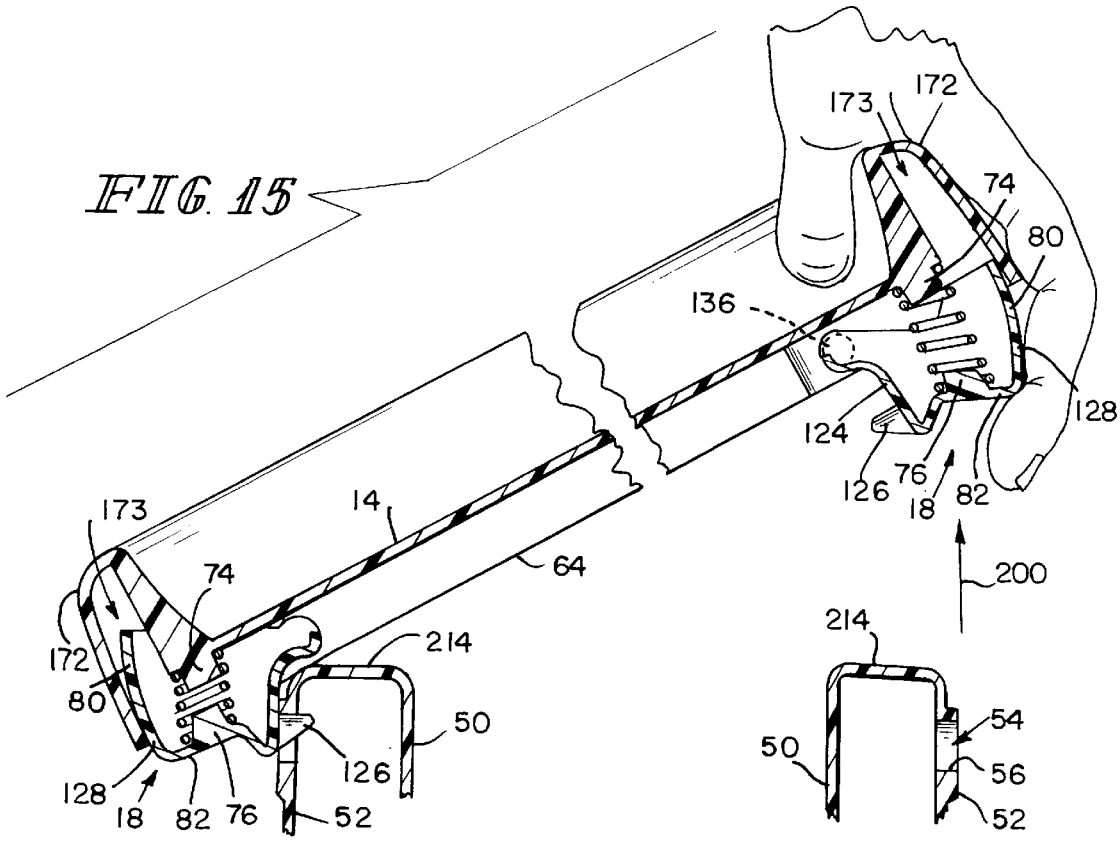
FIG. 15 is a view similar to FIG. 14 showing the tray assembly pivoted upwardly from the seat about the first latch which remains coupled to the tray and arm of the seat.
Figure 16:
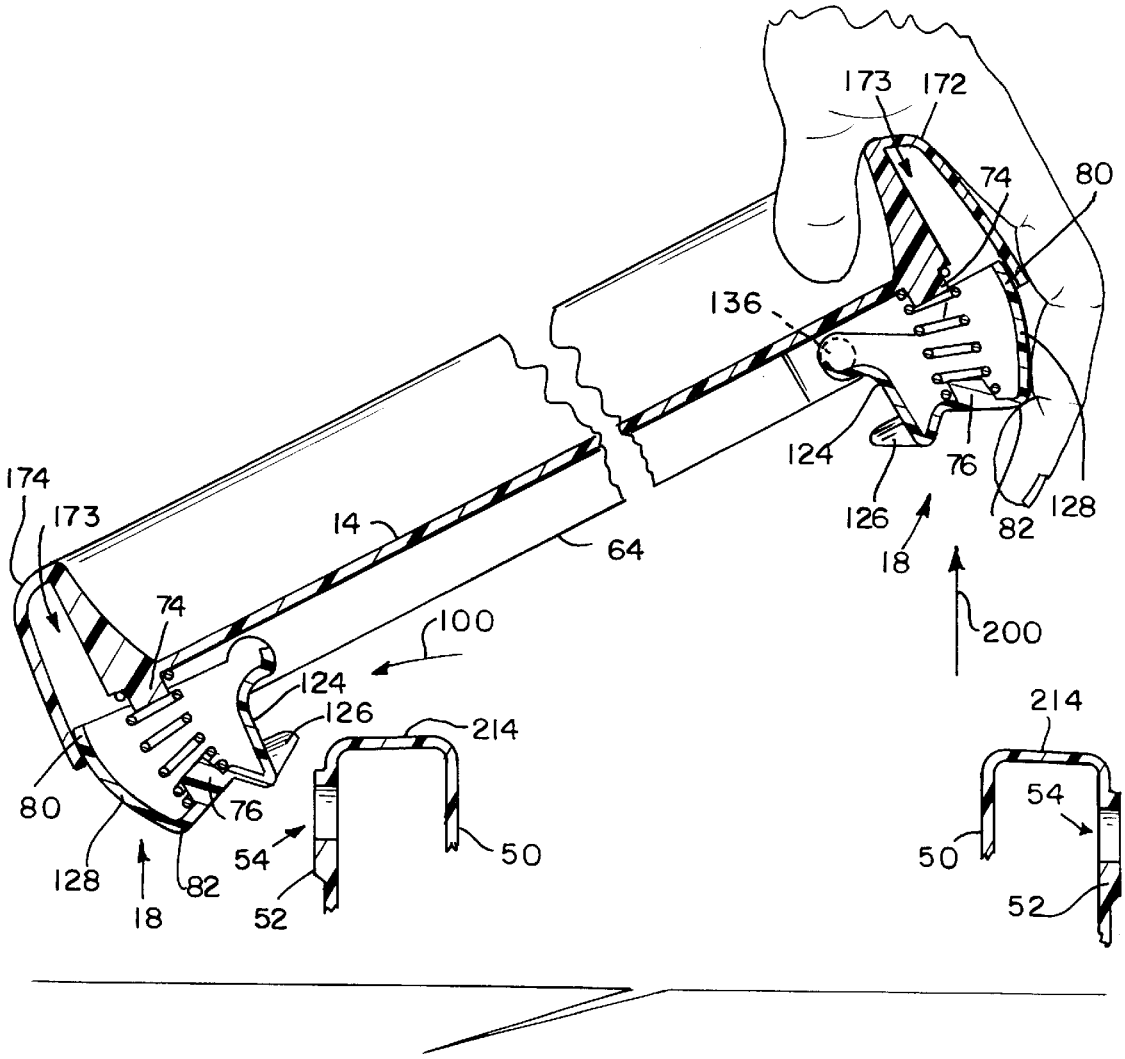
FIG. 16 is a view similar to FIGS. 14 and 15 showing the tray assembly being moved laterally to the left so that the first latch is disengaged from the arm of the chair allowing the tray assembly to be removed from the seat.

FIGS. 14–16 show the necessary steps required to release tray assembly 10 of the present invention from seat 24. Beginning with FIG. 14, caregiver must grasp release handle 128 of first latch 18. By pulling release handle 128 so that upper portion 80 is received within cavity 173, mounting latch 124 is pivoted away from exterior surface 52 of arm 32 so that first latch 18 is positioned to lie in fully-compressed position 212 disengaged from arm 32. Once mounting teeth 126, 127 of first latch 18 have been removed from tray-position slots 54, caregiver needs only to lift first latch 118 in direction 200, as shown in FIG. 15. Tray assembly 10 is thus urged to pivot about opposite latch 18 which has remained engaged with respective arm 32. Now, tray assembly 10 may be moved laterally away from arm 32 as shown by arrow 100 in FIG. 16. Thus, by moving latch 218 to fully-compressed position 212, mounting teeth 126, 127 of opposite latch 218 easily slides out from within tray-position slots 54 without the need for the caregiver to disengage opposite latch 218 from arm 32. Tray assembly 10 may be removed from arms 32 of seat 24 by disengaging one or both latches 18 from arms 32 of seat 24.

Although the invention has been described in detail with reference to certain preferred embodiments, variations and modifications exist within the scope and spirit of the invention.

What is claimed is:

1. A tray assembly for use with a seat having a seat back, a seat bottom, and arms, the tray assembly comprising a tray being adapted to extend across the arms of the seat and including an upper surface, a lower surface, first and second opposite edges, walls coupled to the opposite edges and lower surface to define a cavity therebetween, and a rib extending from at least one of the walls, a first latch coupled to the tray, formed to include a slot for receiving the rib therein, and configured to move between a latched position in which the first latch is adapted to engage the arms of the seat and a release position in which the first latch is adapted to disengage the arms of the seat, and a second latch coupled to the tray, formed to include a slot for receiving another rib therein, and configured to move between a latched position in which the second latch is adapted to engage the arms of the seat and a release position in which the second latch is adapted to disengage the arms of the seat.

2. The tray assembly of claim 1, wherein each latch includes a mounting portion and a release handle coupled to the mounting portion, each wall of the tray is formed to include an aperture, and the mounting portion includes a pin coupled to the tray to mount the latch for pivoting movement relative to the tray.

3. The tray assembly of claim 2, wherein each latch also includes teeth extending from the mounting portion and the teeth are adapted to engage the respective arms of the seat.

4. The tray assembly of claim 1, further comprising springs, each latch being formed to include opposite side walls and a floor portion extending therebetween, and wherein each spring is formed to extend between the floor portion of each latch and the lower surface of the tray.

5. The tray assembly of claim 4, wherein the slot of each latch is formed by one of the side walls and the rib of the tray extends into the slot and engages the side wall when each latch is in the latched and release positions.

6. The tray assembly of claim 1, wherein each latch is formed to include a first inner wall portion and a second inner wall portion that define the slot therebetween and the rib of the tray engages the first inner wall portion when the latch is in the latched position and engages the second inner wall portion when the latch is in the release position.

7. The tray assembly of claim 6, wherein the tray includes a lip that defines a cavity and each latch includes a mounting portion and a release handle coupled to the mounting portion and movable within the cavity during movement of the latch between a fully-extended and a fully-compressed position.

8. The tray assembly of claim 7, wherein the mounting portion of the latch further includes a post received within apertures of the walls of the tray for pivoting movement therewith.

9. The tray assembly of claim 7, wherein the release handle includes a floor portion and further comprising springs and each spring extends between the lower surface of the tray and the floor portion and normally biases the latch toward the fully-extended position.

10. A seat and tray assembly comprising a seat having a seat bottom, a seat back, and arms, a tray including an upper surface, a lower surface, first and second side edges, and a rib extending from the lower surface of the tray, the tray being formed to extend across the arms of the seat, a first latch being coupled to the first side edge of the tray, the first latch being formed to include a slot for receiving the rib and the first latch being movable relative to the tray between a latched position in which the first latch is engaged with a respective arm of the seat and a release position in which the first latch is disengaged from the arm of the seat, and a second latch coupled to the second side edge of the tray and movable between latched and release positions so that the tray is releasable from the arms through movement of the second latch from the latched position to the release position while the first latch remains in the latched position.

11. The seat and tray assembly of claim 10, wherein each arm includes a plurality of slots therein sized to receive the respective latches.

12. The seat and tray assembly of claim 10, wherein the slot is formed to include opposite surfaces and the rib engages one surface when the assembly is in the latched position and alternately engages the opposite surface when the assembly is in the release position.

13. The seat and tray assembly of claim 10, wherein the tray includes spaced-apart walls to form a cavity therebetween and each latch is formed to be received within the respective cavity.

14. The seat and tray assembly of claim 13, wherein each latch includes a mounting portion that has a pin and the walls of the tray each include an aperture such that each pin is received within the apertures in order to pivotally couple each latch to the first and second side edges of the tray.

15. The seat and tray assembly of claim 10, wherein the tray includes walls extending from the lower surface, the walls forming cavities defined by the lower surface and the walls, and each latch is positioned to lie within one of the cavities.

16. The seat and tray assembly of claim 15, wherein each latch includes a tooth with a top portion facing the tray and an opposite bottom portion, and the bottom portion is tapered and guides the latch toward the release position when the tooth engages the arm.

17. A seat and tray assembly comprising a seat including a seat bottom, a seat back, and spaced apart arms extending from the seat bottom, the arms including tray-position slots therein, a tray including an upper surface, an opposite lower surface configured to selectively engage the arms of the seat, opposite side edges, at least one air of parallel walls coupled to the lower surface and one of the side edges to form a cavity therein, and a rib extending from one wall of each pair of parallel walls, a latch received within the cavity of the parallel walls of the tray and being formed to receive one of the ribs, the latch also being formed for movement between a latched position and a release position, the latch including a mounting portion, a release handle, and a mounting tooth being positioned to lie within at least one of the tray-position slots when the latch is in the latched position.

18. The seat and tray assembly of claim 17, wherein the assembly further comprises a spring, the latch comprises a floor portion so that the spring is formed to extend between the floor portion of the latch and the lower surface of the tray and the spring biases the latch to the latched position.

19. The seat and tray assembly of claim 17, wherein the latch is formed to include a first inner wall portion and a second inner wall portion that define a slot therebetween and the rib of the tray engages the first inner wall portion when the latch is in the latched position and engages the second inner wall portion when the latch is in the release position.

20. The seat and tray assembly of claim 17, wherein the tray and latch are cooperatively formed to include limit means for restricting pivoting movement of the latch relative to the tray between the latched position and the release position.

21. A tray assembly for use with a seat having a seat back, a seat bottom, and arms, the tray assembly comprising a tray including an upper surface adapted to extend across the arms of the seat, walls positioned to lie under the upper surface, and a rib extending from at least one of the walls, and a latch coupled to the walls, the latch formed to include a slot sized to receive the rib therein and configured to move between a latched position in which the latch is adapted to engage the arm of the seat and a release position in which the latch is adapted to disengage the arm of the seat.

22. The tray assembly of claim 21, wherein the latch is formed to include a first inner wall portion and a second inner wall portion that define the slot and the rib of the tray engages the first inner wall portion when the latch is in the latched position and engages the second inner wall portion when the latch is in the release position.

23. The tray assembly of claim 21, wherein the latch includes a mounting portion coupled to the walls and formed for pivoting movement relative to the surface of the tray and a release handle coupled to the mounting portion.

24. The tray assembly of claim 23, wherein the mounting portion includes teeth adapted to engage the arm of the seat.

25. A seat and tray assembly comprising a seat including a seat bottom, a seat back, and arms extending from the seat bottom, a tray including a surface configured to selectively engage the arms of the seat, at least one pair of walls positioned to lie under the surface to form a cavity therebetween, and a rib extending from at least one wall of each pair of walls, and a latch received within the cavity and formed to receive the rib, the latch being positioned to move in the cavity between a latched position and a release position, the latch including a mounting portion, a release handle, and at least one tooth being positioned to engage one of the arms when the latch is in the latched position.

26. The seat and tray assembly of claim 25, wherein a slot is formed to include opposite surfaces and the rib engages one surface when the assembly is in the latched position and engages the opposite surface when the assembly is in the release position.

27. The seat and tray assembly of claim 25, wherein the at least one tooth includes a top portion facing the tray and a tapered bottom portion formed to guide the latch toward the release position when the at least one tooth engages the arm.

* * * * *